US006642646B1

(12) United States Patent
Kwon

(10) Patent No.: US 6,642,646 B1
(45) Date of Patent: Nov. 4, 2003

(54) ELECTRON GUN FOR COLOR CATHODE RAY TUBES WITH SIDE ELECTRON-BEAM-PASSING APERTURES OF PLURALITY OF CIRCULAR ARCS HAVING DIFFERENT RADII OF CURVATURE

(75) Inventor: Oh So Kwon, Kyungsangbuk-do (KR)

(73) Assignee: Orion Electric Co., Ltd., Kyungsangbuk-do (KR)

( * ) Notice: Subject to any disclaimer, the term of this patent is extended or adjusted under 35 U.S.C. 154(b) by 0 days.

(21) Appl. No.: 09/980,876

(22) PCT Filed: May 15, 2000

(86) PCT No.: PCT/KR00/00469

§ 371 (c)(1),
(2), (4) Date: Nov. 15, 2001

(87) PCT Pub. No.: WO00/70637

PCT Pub. Date: Nov. 23, 2000

(30) Foreign Application Priority Data

May 19, 1999 (KR) ..... 99-18147

(51) Int. Cl.[7] ..... H01J 29/50
(52) U.S. Cl. ..... 313/414; 313/409; 313/437
(58) Field of Search ..... 313/414, 415, 313/409, 426, 427, 437

(56) References Cited

U.S. PATENT DOCUMENTS

| | | | | | |
|---|---|---|---|---|---|
| 4,583,024 | A | * | 4/1986 | Chen | 313/414 |
| 5,027,043 | A | * | 6/1991 | Chen et al. | 315/368.11 |
| 5,461,278 | A | * | 10/1995 | Misono et al. | 313/414 |
| 5,488,265 | A | * | 1/1996 | Chen | 313/414 |
| 5,883,463 | A | * | 3/1999 | Kikuchi et al. | 313/414 |
| 6,255,767 | B1 | * | 7/2001 | Lee et al. | 313/414 |

* cited by examiner

*Primary Examiner*—Vip Patel
*Assistant Examiner*—Kevin Quarterman
(74) *Attorney, Agent, or Firm*—Notaro & Michalos P.C.

(57) ABSTRACT

An in-line electron gun for a colored cathode ray tube has an electronic field correction plates with a central key-hole shaped aperture with two opposite straight lines and two side apertures each with a plurality of vertical and horizontal in addition to a plurality of circular arcs of different radii.

4 Claims, 6 Drawing Sheets

G1
G2
G3
G4
G5
G6
KR
KG
KB
1
2
3
4
5
6
7
8
9
10
EC2
EC3
Eb

FIG.4A
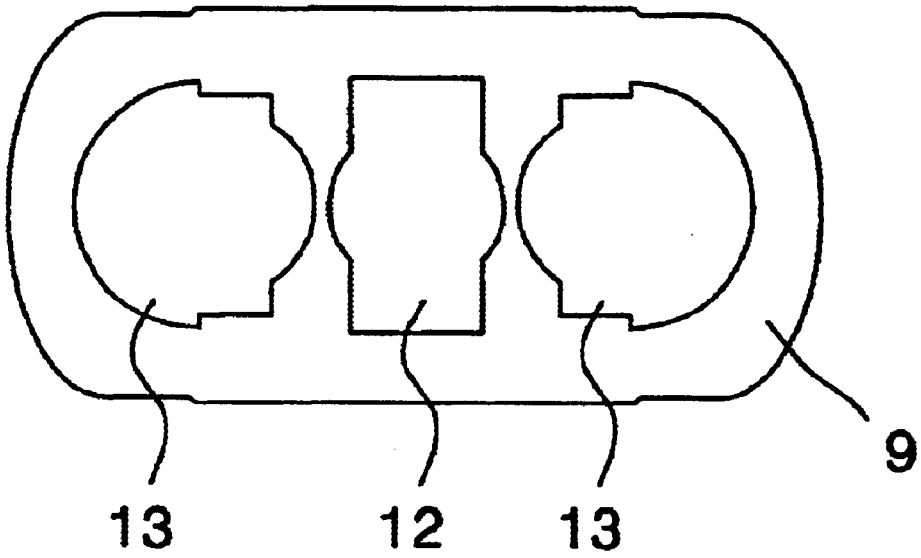
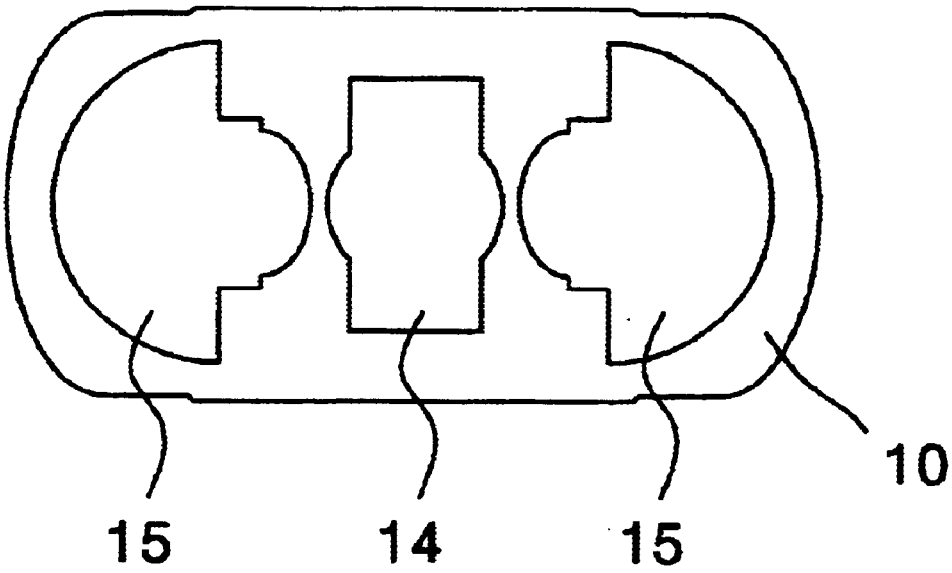
FIG.4B

ELECTRON GUN FOR COLOR CATHODE RAY TUBES WITH SIDE ELECTRON-BEAM-PASSING APERTURES OF PLURALITY OF CIRCULAR ARCS HAVING DIFFERENT RADII OF CURVATURE

TECHNICAL FIELD

The present invention relates to an in-line electron gun for a color cathode ray tube and, more particularly, to an electric field correction plate for correcting aberration such as astigmatism in a main lens of the electron gun, in which a central aperture is of a key-hole shape and side apertures are of a asymmetric circular shape so as to make up for an assembly error caused by the application of the prior art elliptical shape to the main lens, thereby improving the assembly characteristics and the focusing characteristics.

BACKGROUND ART

Recently, in order to improve resolution characteristics of an in-line electron gun for a color cathode ray tube, the prior art separate type main lens becomes changed to the common type rim lens, and an enlarged aperture becomes applied to the main lens.

In this electron gun having the enlarged aperture, the difference in an opening size between the horizontal and the vertical direction causes the main lens to become asymmetric and the focusing forces to become different between the horizontal and the vertical directions, thereby causing aberration and distorting electron beams. That is, there is a problem that astigmatism and coma aberration occur in the main lens and thus exert a bad influence on the focusing characteristics.

In recent, an arrangement for compensating for such aberration is widely used wherein electric field correction plates are applied to the large aperture type main lens.

In a common electric field correction plate as shown in FIG. 3, three apertures 11 are arranged in line and the shapes of the apertures 11 are elliptical, which control the intensity of lens between the horizontal direction and the vertical direction by the change of the elliptical shape, and thus compensate for the aberration in the main lens. For clearly correcting the aberration of the main lens and improving the performance of the electron gun, the electric field correction plates 9, 10 must be assembled in the electron gun with high precision.

However, it is very difficult to assemble such electric field correction plate with high precision since the apertures in the electric field correction plates are elliptical, thereby deteriorating the whole focusing characteristics of the electron gun according to a lowering of the assembly precision.

To alleviate such a problem in Japanese Patent Hei 6-75378, only the central aperture of the electric field correction plate is elliptical and opposite side apertures of the electric field correction plate are circular, thereby improving the assembly characteristics. However, it is very difficult to correct astigmatism of opposite side beams by such electric field correction plate. Otherwise, there is a problem that the main lens should become complicated in the structure as compared with the prior art main lens.

Meanwhile, the in-line electron gun for a color cathode ray tube disclosed in U.S. Pat. No. 4,583,024, issued on Apr. 1, 1986, comprises a main focus lens formed by two spaced electrode members, each having three separate inline apertures therein, a central aperture and two side apertures. The improvement comprises each of the apertures in each of the focus lens electrodes having a shape that distorts a portion of the focus lens thereat, to at least partially compensate for an astigmatic effect without any further additional part. The side apertures in both of the electrodes are nonsymmetrical about axes that pass through the respective side apertures and are perpendicular to the initial coplanar paths of the electron beams. In this case, astigmatism is partially compensated for, but little effect can be obtained.

U.S. Pat. No. 4,833,364, issued to Izumida, et al., on May 23, 1989 discloses an electron gun for color picture tubes, wherein a focus grid and an anode made of elongated plates serves as main lens electrodes, and three apertures of the focus grid and the anode constitute a main lens assembly. The three apertures of each of the elongated plates have a central aperture defined by two first curves arcuated outward, and two side apertures each of which is defined by a second curve as an inner half arcuated inward and a third curve as an outer half arcuated outward, the first and second curves being less arcuated than the third curve. Elliptical rings are bonded to the elongated plates such that the end portions of the rings are constituted by semicircular portions aligned with those of the side apertures, thereby preventing astigmatism.

However, in such constitution, the shape of the inner wall in the ring electrodes and the shape of the elongated plates should be changed to control the path of the electron beams, thereby causing the change of the tube size to be difficult. That is, the anode voltage and the intensity of the main lens should be changed for the larger size tubes, but it is very difficult to change the path of the electron beams only by the change of the shape of the elongated plates since the cylindrical inner wall in the ring electrodes serves as an static electric lens electrode.

DISCLOSURE OF INVENTION

The present invention has been made to overcome the above described problems of the prior arts, and accordingly it is an object of the present invention to provide an in-line electron gun for a color cathode ray tube, which improves the assembly characteristics and compensates for aberration such as astigmatism, thereby substantially improving the focusing characteristics over the whole phosphor screen.

To achieve the above object, the present invention provides an in-line electron gun for a color cathode ray tube, which includes an electron beam generating means for generating and directing three electron beams along paths toward a phosphor screen, and a main lens of a large aperture type for focusing the three electron beams radiated from said electron beam generating means, said in-line electron gun for a color cathode ray tube being characterized in that said main lens is formed between a focusing electrode and an accelerating electrode; and electric field correction plates are disposed in each of the focusing electrode and an accelerating electrode in the vertical direction to electron beam passing axes, and have three electron beam passing apertures aligned in line, respectively, said three apertures comprising at least one central electron beam passing aperture of a key-hole shape which is symmetrical with respect to a vertical line to a central electron beam passing axis and two side electron beam passing apertures each of which is defined by a plurality of circular arcs having different radii of curvature, connected to each other circular arc, and asymmetrical with respect to a vertical line to each side electron beam passing axis.

It is preferred that each of said two side electron beam passing apertures of the electric field correction plates has the circular arc toward the central electron beam passing aperture smaller in radius of curvature than the circular arc far from the central electron beam passing aperture, and said plurality of circular arcs of the side electron beam passing apertures are connected by even-numbered straight lines.

Also, it is preferred that each of said two side electron beam passing apertures of the electric field correction plates has a shape of a key-hole toward the central electron beam passing aperture and a shape of an arcuate curve far from the central electron beam passing aperture. That is, each of said two side electron beam passing apertures of the electric field correction plates has a shape of a key-hole at one side with respect to a vertical line to each side electron beam passing axis and a shape of an arcuate curve at other side with respect to a vertical line to each side electron beam passing axis.

Furthermore, each radius of the circular arcs constituting said three electron beam passing apertures of the electric field correction plate disposed in the focusing electrode is preferrably smaller than each radius of the circular arcs constituting said three electron beam passing apertures of the electric field correction plate disposed in the accelerating electrode, and each of said three electron beam passing apertures of the electric field correction plate disposed in the focusing electrode may have a shape of a key-hole.

BRIEF DESCRIPTION OF DRAWINGS

FIGS. 4A and 4B are plan views of electric field correction plates constituting a main lens according to one embodiment of the present invention.

BEST MODE FOR CARRYING OUT THE INVENTION

The present invention will be described in detail with reference to the accompanying drawings.

Figure 5:
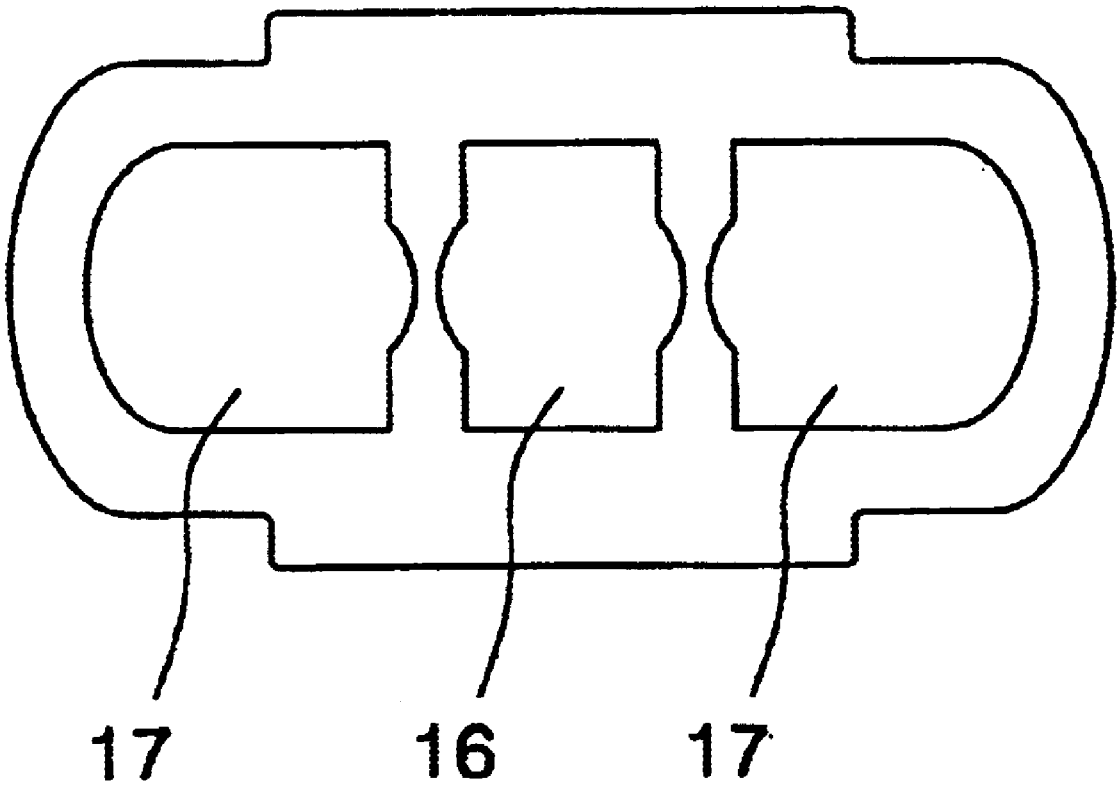
FIG. 5 is a plan view of one electric field correction plate constituting a main lens according to another embodiments of the present invention.

Each shape of the central electron beam passing apertures 12 and 14 and two side electron beam passing apertures 13 and 15 of electric field correction plates 9 and 10 according to one embodiment of the present invention is shown in FIGS. 4A and 4B, and each shape of a central electron beam passing aperture 16 and two side electron beam passing apertures 17 of the electric field correction plate 9 according to another embodiment of the present invention is shown in FIG. 5.

In FIG. 4A the electric field correction plate 9 has three electron beam passing apertures 12, 13 and 13 aligned in line, and in FIG. 4B the electric field correction plate 10 has three electron beam passing apertures 14, 15 and 15. Each of said three electron beam passing apertures 12, 13 and 13, and 14, 15 and 15 comprises at least one central electron beam passing aperture 12 or 14 of a key-hole shape which is symmetrical with respect to a vertical line to a central electron beam passing axis, and two side electron beam passing apertures 13 and 13, or 15 and 15 defined by a plurality of asymmetric circular arcs, thereby improving the assembly precision. Also, the focusing characteristics over the whole phosphor screen are substantially improved since aberration such as astigmatism, coma aberration, etc., caused in the electron gun is substantially compensated for due to said plurality of asymmetric circular arcs of the side electron beam passing apertures 13 and 13, or 15 and 15.

Figure 1:
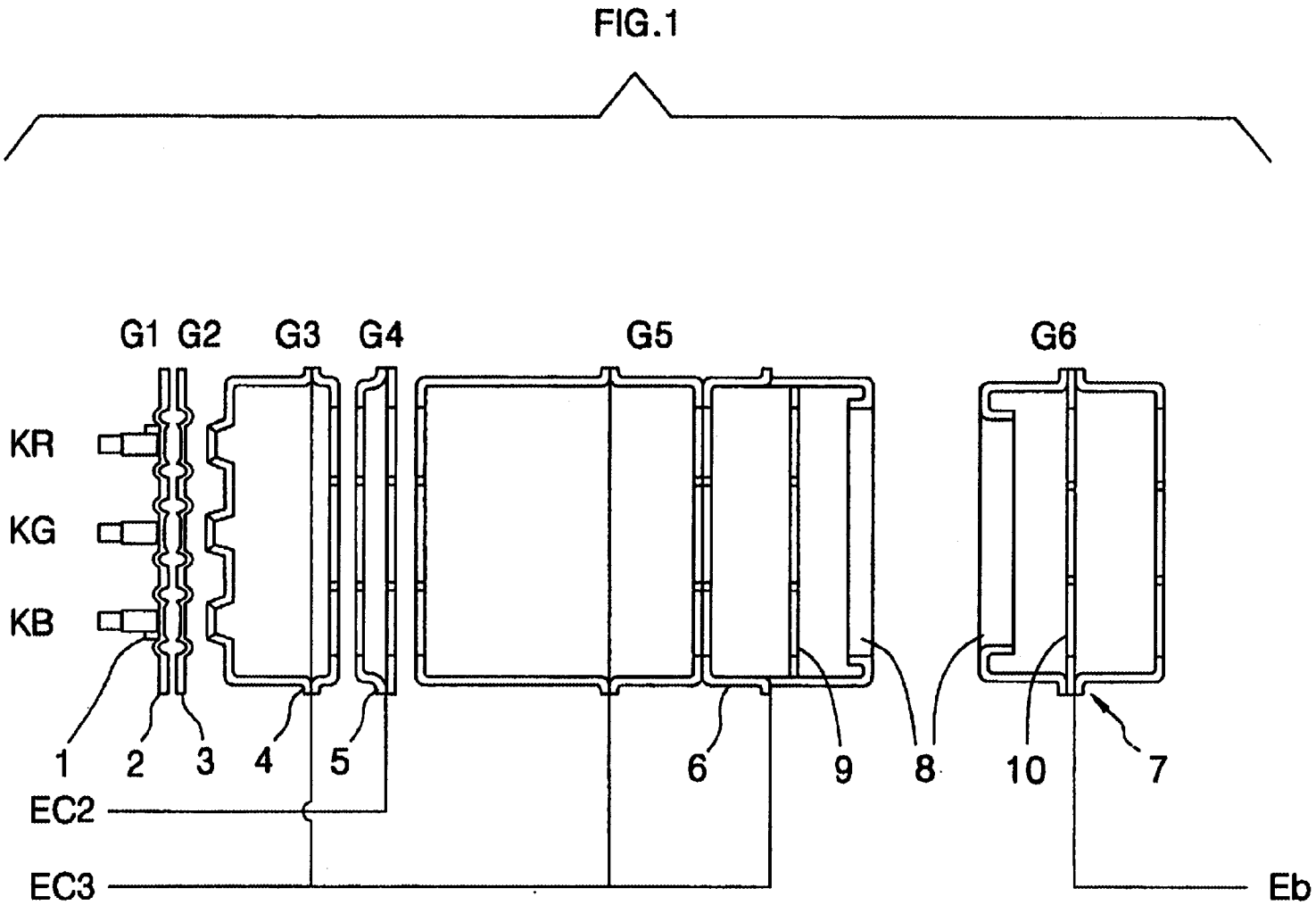
FIG. 1 is a sectional view showing the structure of an in-line electron gun for a color cathode ray tube embodying the present invention.
Figure 2B:
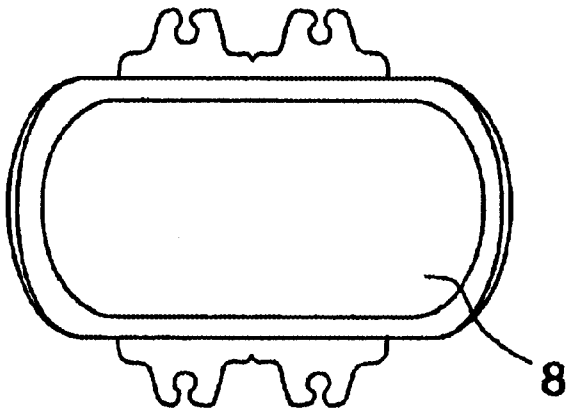
FIG. 2B is a front elevational view of one of the lens electrodes.
Figure 2C:
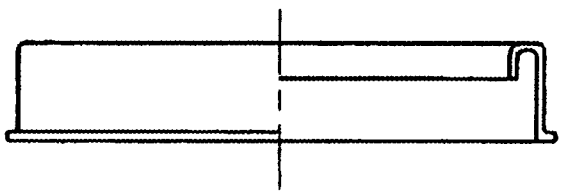
FIG. 2C is a side view partly in section of the electrode of FIG. 2B.
Figure 2A:
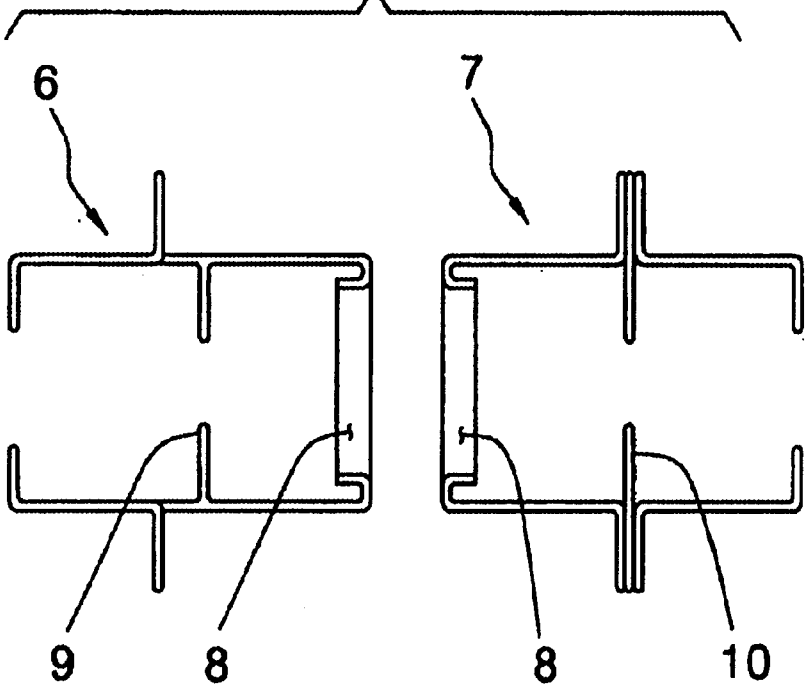
FIG. 2A is a sectional view showing the structure of main lens electrodes embodying the present invention.

FIG. 1 shows the structure of an in-line electron gun for a color cathode ray tube embodying the present invention. A main lens comprising a focusing electrode 6 or a fifth electrode G5 and an accelerating electrode 7 or a sixth electrode G6 in FIG. 1 is shown in FIGS. 2A to 2C in detail and each with an open passage 8.

In FIG. 1, the in-line electron gun comprises three spaced inline cathodes 1 for emitting electron beams, a first electrode G1 or a control electrode 2, a second electrode G2 or a screen electrode 3, a third electrode G3 or a focusing electrode 4, a forth electrode G4 or a screen electrode 5, a fifth electrode G5 or a focusing electrode 6, and a sixth electrode G6 or an accelerating electrode 7.

With this arrangement, an electric voltage between 0V and around 100V is applied to the cathodes 1, the first electrode 2 is grounded, an electric voltage EC3 between 400V and 800V is applied to the second and the forth electrodes 3 and 5, an electric voltage EC2 between 400V and 800V is applied to the second and the third electrodes 3 and 5, an electric voltage Eb between 5 KV and 8 KV is applied to the third and fifth electrodes 4 and 6, and an electric voltage between 20 KV and 30 KV is applied to the sixth electrode 7.

Although the electron beams are focused at the central portion of the phosphore screen in the conventional electron gun, the electron beams are not converged to one point at the peripheral portion of the phosphore screen due to the difference of the curvatures of a panel and the distances of the electron beam paths from the central portion, and the spots of the electron beams are enlarged due to the difference of the lens magnifications in the rim main lens of the focusing electrode 6 and the accelerating electrode 7, thereby degrading the resolution of an image.

Figure 3:
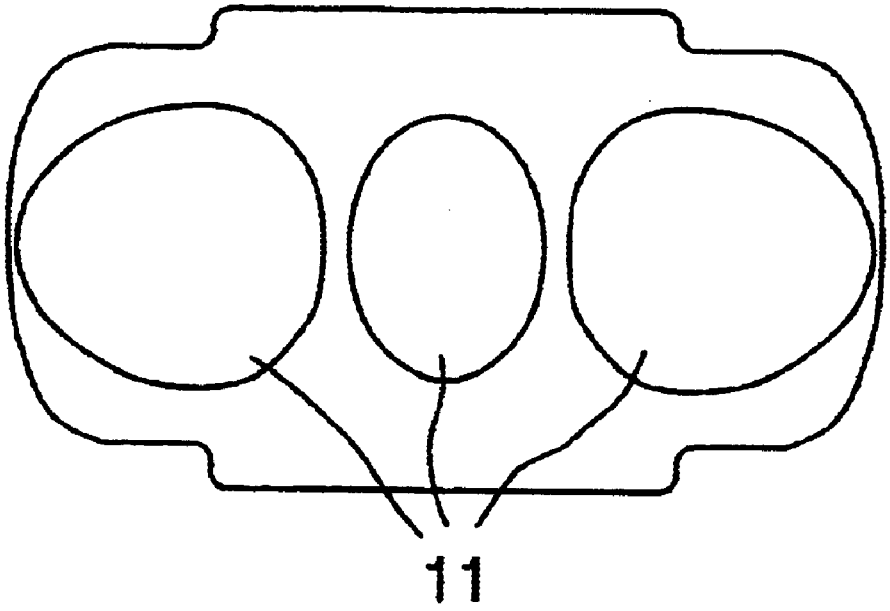
FIG.3 (PRIOR ART)
FIG. 3 is a plan view of the prior art electric field correction plate constituting a main lens.

To compensate for such asymmetry of the electric field, electric field correction plates are adopted in the prior art electron gun and the apertures 11 thereof become elliptical as shown in FIG. 3, thereby forming a new asymmetrical lens and correcting aberration of the rim main lens in reverse. However, an eccentric assembly jig is required for assembling such electron gun. Still, it is difficult to assemble such electric field correction plates with desirable high precision since rods of the assembly jig are circular, thereby failing to improve the resolution of the electron gun according to the assembled position of the electric field correction plates.

Accordingly, in the present invention made to overcome the above described problems of the prior arts, one central electron beam passing aperture 12 or 14 of the electric field correction plates 9 and 10 has a key-hole shape as shown in FIGS. 4A and 4B, and two side electron beam passing apertures 13 or 15 of the electric field correction plates 9 and 10 have of shape defined by a plurality of asymmetric circular arcs.

That is, said main lens is formed between a focusing electrode 6 and an accelerating electrode 7 as shown in FIGS. 1 and 2. The electric field correction plates 9 and 10 are disposed in each of the focusing electrode 6 and an accelerating electrode 7 in the vertical direction to electron beam passing axes. In FIG. 4 and 5, the electric field correction plates 9 and 10 have three electron beam passing apertures aligned in line, respectively. Said three apertures comprise at least one central electron beam passing aperture 12 or 14 of a key-hole shape which is symmetrical with respect to a vertical line to a central electron beam passing axis, and two side electron beam passing apertures 13 or 15, each of which is defined by a plurality of circular arcs having different radii of curvature, connected to each other circular arc and asymmetrical with respect to a vertical line to each side electron beam passing axis.

FIG. 5 shows apertures 16 and 17 in the electric field correction plate 9 constituting a main lens according to another embodiments of the present invention, which are different in shape form, but act as the same function as, the apertures 12 and 13 in the electric field correction plate 9 as shown in FIG. 4A.

In detail, the side electron beam passing apertures 15 of the electric field correction plate 10 as a divergence lens electrode disposed in the sixth electrode 7 is made larger in the radius of the curvature of the circular arcs than the side electron beam passing apertures 13 and 17 of the electric field correction plate 9 as a focusing lens electrode disposed in the sixth electrode 6, thereby becoming a system for controlling, and compensating for, the aberration and facilitating the compensation for the aberration of the side electron beams as such asymmetric lens. Thus, the focusing performance becomes improved over the whole phosphore screen. Furthermore, each of said two side electron beam passing apertures 13 and 15 of the electric field correction plates 9 and 10 may have the circular arc toward the central electron beam passing aperture 12 and 14 smaller in radius of curvature than the circular arc far from the central electron beam passing aperture 12 and 14.

With the electric field correction plates 9 and 10 according to the above embodiments of the present invention, the assembly precision by the prior art assembly jig are greatly improved as compared with the assembly of the prior art electron gun because the electron beam passing apertures comprise circular arcs, thereby facilitating the precise correction of aberration by means of the circular electron beam passing aperture and the side electron beam passing apertures 13 or 15 of the asymmetrical radii, and further facilitating the design of the main lens.

In FIGS. 4A 4B and 5, said side electron beam passing apertures 13, 15 and 17 are formed by connecting said plurality of circular arcs by even-numbered straight lines. Furthermore, each of said side electron beam passing apertures 13, 15 and 17 of the electric field correction plates 9 and 10 has a shape of a key-hole close to the central electron beam passing aperture 12, 14 or 16, and a shape of an arcuate curve remote from the central electron beam passing aperture 12, 14 or 16 as shown in FIGS. 4A, 4B and 5. That is, the shape of each of the side electron beam passing apertures 13, 15 and 17 is formed of a key-hole shape at one side with respect to a vertical line to each side electron beam passing axis, and of an arcuate curve shape at other side with respect to the vertical line. All three electron beam passing apertures 12 and 13 of the electric field correction plate 9 disposed in the focusing electrode 6 may be made of a keyhole shape.

In the meantime, each radius of the circular arcs constituting said three electron beam passing apertures of the electric field correction plate 9 disposed in the focusing electrode 6 may be selected smaller than each radius of the corresponding circular arcs constituting said three electron beam passing apertures of the electric field correction plate 10 disposed in the accelerating electrode 7.

As described above, by forming the three electron beam passing apertures of the electric field correction plates 9 and 10 with key-hole shapes and asymmetric circular arc shapes in the in-line electron gun for a color cathode ray tube according to the present invention, the assembly characteristics are greatly improved and aberration of the main lens is compensated for by means of the asymmetrical circular arcs as compared with the prior art three electron beam passing apertures 11 of an elliptic shape. Thus, the focusing characteristics over the whole phosphor screen become largely improved.

Moreover, the charge and voltage-resistance characteristics are also improved. In the prior art main lens electrode, a large quantity of burrs are formed by putting the piercing direction of the aperture in reverse for enlarging the Vertical aperture due to the decrease of the spheric aberration, thereby deteriorating voltage-resistance characteristics. In the present invention, it can be improved because the piercing direction of the aperture can be changed. Also, since no burr is formed in the main lens electrode and the electrode is close to the inner wall of the neck, some electrons are drifted through a gap of the main lens to the inner wall of the neck, thereby causing the charge drift. In the present invention, such charge drift becomes removed by adding a burring of about 1.2 mm length to the main lens electrode.

Also, in the focusing grade quality, astigmatism could be decreased by enlarging the size of the core of the electron beam in the horizontal and the vertical directions and changing the shape of the astigmatic plate electrode. And the size of the spot in the horizontal and the vertical directions can become optimized by changing a gap between the electrodes.

The above-mentioned improvement is applied in actual practice with each cathode current of $I_x$=120 $\mu$A and $I_x$=200 $\mu$A, which results are compared with the prior art electron gun in the following table:

| FOCUS | SPOT SIZE (mm) | | | | |
|---|---|---|---|---|---|
| | CENTER BEAM | | OUTER BEAM | | |
| VOLTAGE (Volt) | 5% | EDGE | 5% | EDGE | Centroid |
| | $I_K$ = 120 $\mu$A (the prior art) | | | | |
| 5700 | 1.0178/0.450 | 1.716/0.908 | 10126/0.481 | 1.676/1.063 | 4.86 |

-continued

| FOCUS | SPOT SIZE (mm) | | | | |
|---|---|---|---|---|---|
| | CENTER BEAM | | OUTER BEAM | | |
| VOLTAGE (Volt) | 5% | EDGE | 5% | EDGE | Centroid |
| 5800 | 0.949/0.361 | 1.425/0.871 | 0.912/0.422 | 10445/1.081 | 4.87 |
| 5900 | 0.728/0.309 | 1.128/0.863 | 0.723/0.394 | 1.211/1.055 | 4.89 |
| 6000 | 0.507/0.353 | 0.873/0.833 | 0.564/0.419 | 1.000/1.011 | 4.90 |
| 6100 | 0.311/0.394 | 0.628/0.877 | 0.452/0.437 | 0.775/0.974 | 4.92 |
| 6200 | 0.21510.438 | 0.409/0.908 | 0.409/0.460 | 0.711/0.994 | 4.93 |
| 6250 | 0.233/0.460 | 0.350/0.930 | 0.381/0.515 | 0.646/1.066 | 4.94 |
| 6300 | 0.275/0.483 | 0.336/1.021 | 0.395/0.546 | 0.604/1.1.04 | 4.95 |
| $I_K$ = 120 $\mu$A (the present invention) | | | | | |
| 6650 | | | 0.446/0.486 | 0.793/1.211 | 4.87 |
| 6700 | 0.236./0.446 | 0.610/1.118 | 0.370/0.460 | 0.721/1.267 | 4.88 |
| 6750 | 0.228/0.426 | 0.550/1.111 | 0.314/0.481 | 0.648/1.334 | 4.89 |
| 6800 | 0.205/0.405 | 0.478/1.121 | 0.327/0.481 | 0.572/1.368 | 4.89 |
| 6850 | 0.226/0.398 | 0.390/1.154 | 0.321/0.497 | 0.505/1.391 | 4.90 |
| 6900 | 0.251/0.409 | 0.328/1.182 | 0.343/0.520 | 0.486/1.406 | 4.91 |
| 6950 | 0.295/0.435 | 0.356/1.199 | | | |
| $I_K$ = 200 $\mu$A (the prior art) | | | | | |
| 6100 | 0.322/0.582 | 0.918/0.892 | 0.417/0.560 | 0.807/1.064 | 4.92 |
| 6150 | 0.242/0.600 | 0.749/0.927 | 0.413/0.589 | 0.757/1.018 | 4.93 |
| 6200 | 0.263/0.637 | 0.617/0.906 | 0.407/0.617 | 0.707/1.050 | 4.94 |
| 6250 | 0.291/0.672 | 0.484/.0932 | 0.452/0.641 | 0.677/1.022 | 4.95 |
| $I_K$ = 200 $\mu$A (the present invention) | | | | | |
| 6650 | 0.276/0.401 | 0.653/1.072 | 0.351/0.548 | 0.789/1.073 | 4.87 |
| 6700 | 0.232/0.426 | 0.535/1.092 | 0.330/0.579 | 0.687/1.112 | 4.88 |
| 6750 | 0.259/0.449 | 0.444/1.100 | 0.356/0.597 | 0.578/1.127 | 4.89 |
| 6800 | 0.290/0.484 | 0.374/1.114 | 0.379/0.626 | 0.501/1.461 | 4.90 |
| 6850 | 0.344/0.515 | 0.424/1.081 | | | |

Figure 6A:
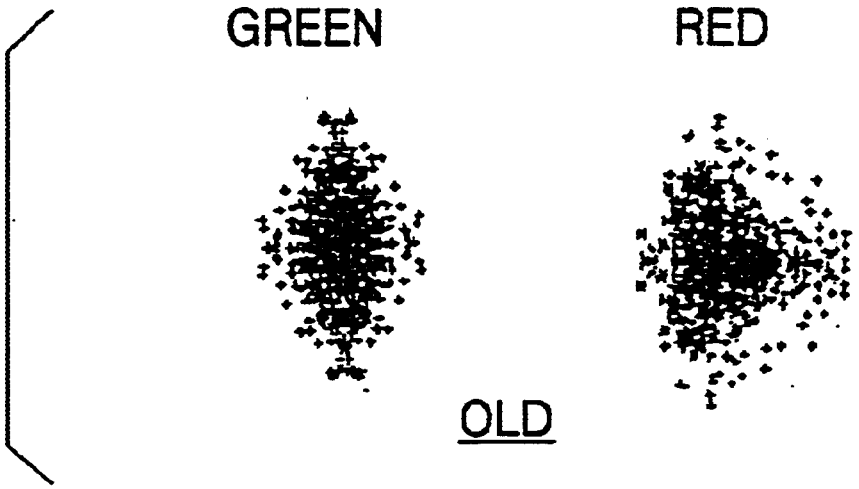
FIG.6A (PRIOR ART)
FIG. 6A is shape diagrams of the conventional electron beam spots and FIG. 6B shape diagrams of electron beam spots according to the present invention.
Figure 6B:
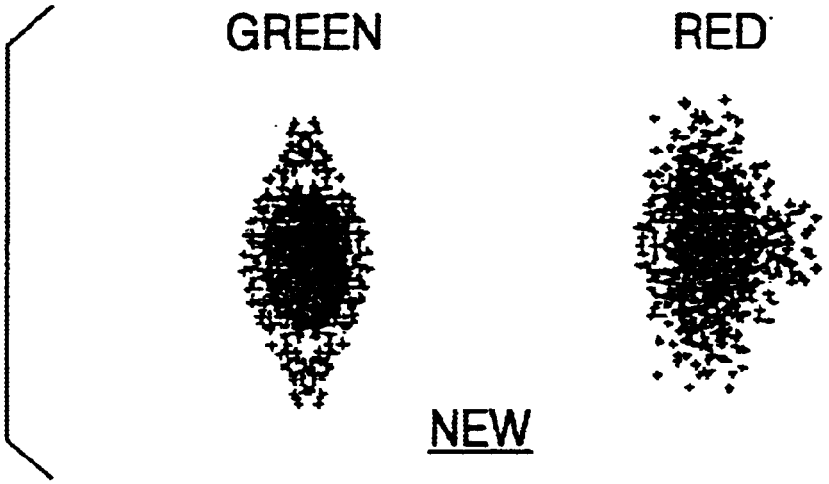

FIG. 6A is shape diagrams of the conventional electron beam spots, which represent weak focusing. In FIG. 6B showing shape diagrams of electron beam spots according to the present invention, the core portions of the electron beams are increased and the halo portions of the electron beams are decreased, thereby greatly improving the focusing and spot characteristics as compared with the prior art electron gun.

As described above according to the embodiments of the present intention, the assembly characteristics of the electron gun and the focusing characteristics over the whole phosphor screen through the reverse compensation for aberration of the main lens are greatly improved by means of the central electron beam passing aperture 12 or 14 of a key-hole shape and two side electron beam passing apertures 13 or 15 of a asymmetric circular shape in the electric field correction plates 9 and 10.

While the present invention has been particularly shown and described with reference to the particular embodiments thereof, it will be understood by those skilled in the art that various changes in form and details may be effected therein without departing from the spirit and scope of the invention as defined by the appended claims.

What is claimed is:

1. An in-line electron gun for a color cathode ray tube, which includes an electron beam generating means for generating and directing three electron beams along paths toward a phosphor screen, and a main lens of a large aperture type for focusing the three electron beams radiated from said electron beam generating means, said in-line electron gun for a color cathode ray tube being characterized in that:

said main lens is formed between a focusing electrode and an accelerating electrode; and electric field correction plates disposed in each of the focusing electrode and an accelerating electrode in the vertical direction to electron beam passing axes, and have three electron beam passing apertures aligned in line, respectively, said three apertures comprising at least one central electron beam passing aperture of a key-hole shape which is symmetrical with respect to a vertical line to a central electron beam passing axis and which includes two opposite straight lines, and two side electron beam passing apertures each of which is defined by a plurality of circular arcs having different radii of curvature, connected to each other circular arc by a plurality of straight lines including at least two opposite and parallel straight lines and asymmetrical with respect to a vertical line to each side electron beam passing axis.

2. An in-line electron gun according to claim 1, wherein each of said two side electron beam passing apertures of the electric field correction plates has a shape of a key-hole toward the central electron beam passing aperture which has the circular arc smaller in radius of curvature, and a shape of an arcuate curve larger in radius of curvature far from the central electron beam passing aperture.

3. An in-line electron gun according to one of claim 1, wherein each radius of the circular arcs constituting said three electron beam passing apertures of the electric field correction plate disposed in the focusing electrode is smaller than each radius of the circular arcs constituting said three electron beam passing apertures of the electric field correction plate disposed in the accelerating electrode.

4. An in-line electron gun according to one of claim 1, wherein each of said three electron beam passing apertures of the electric field correction plate disposed in the focusing electrode has a shape of a key-hole.

* * * * *